United States Patent [19]

Himeji et al.

[11] 4,199,279

[45] Apr. 22, 1980

[54] METHOD AND APPARATUS FOR PLACING CONCRETE UNDER WATER

[75] Inventors: Akio Himeji, Machida; Tadahiko Okumura, Higashikurume; Yasuo Kajioka, Tokyo, all of Japan

[73] Assignee: The Shimizu Construction Co., Ltd., Tokyo, Japan

[21] Appl. No.: 889,339

[22] Filed: Mar. 23, 1978

[30] Foreign Application Priority Data

| | | | |
|---|---|---|---|
| Mar. 25, 1977 | [JP] | Japan | 52-33061 |
| Jun. 18, 1977 | [JP] | Japan | 52-72537 |
| Oct. 27, 1977 | [JP] | Japan | 52-128986 |

[51] Int. Cl.[2] ..... E02D 15/06

[52] U.S. Cl. ..... 405/303; 251/5; 405/223; 405/233

[58] Field of Search ..... 405/195, 222, 223, 233, 405/303; 251/5

[56] References Cited

U.S. PATENT DOCUMENTS

| | | | |
|---|---|---|---|
| 2,750,959 | 6/1956 | von Seggern | 251/5 X |
| 3,007,416 | 11/1961 | Childs | 251/5 X |
| 3,481,610 | 12/1969 | Slator et al. | 251/5 X |
| 3,791,153 | 2/1974 | Inoue et al. | 405/223 |
| 4,129,008 | 12/1978 | Nakahara | 405/303 |

*Primary Examiner*—David H. Corbin

*Attorney, Agent, or Firm*—Weingarten, Maxham & Schurgin

[57] ABSTRACT

An improved method and apparatus for placing concrete under water in an easy and effectual manner. The method comprises the steps of: immersing a tremie tube having a special valve device, into water; transferring concrete through the tremie tube; closing the valve device while the outlet of the tremie tube is kept within the deposited concrete; and lifting the tremie tube to move it to another point. The above valve device is provided with a cylindrical elastic valve member fitted in a cylindrical member forming a space to receive a fluid under pressure and, when the fluid space is supplied with a pressurized fluid, the elastic valve member is folded and expanded in inward radial directions to close up the concrete passage of the tremie tube. Another aspect of the invention is to propose the measurement of the state of deposited concrete by means of a concrete surface detecting device.

5 Claims, 19 Drawing Figures

F I G.17
F I G.16
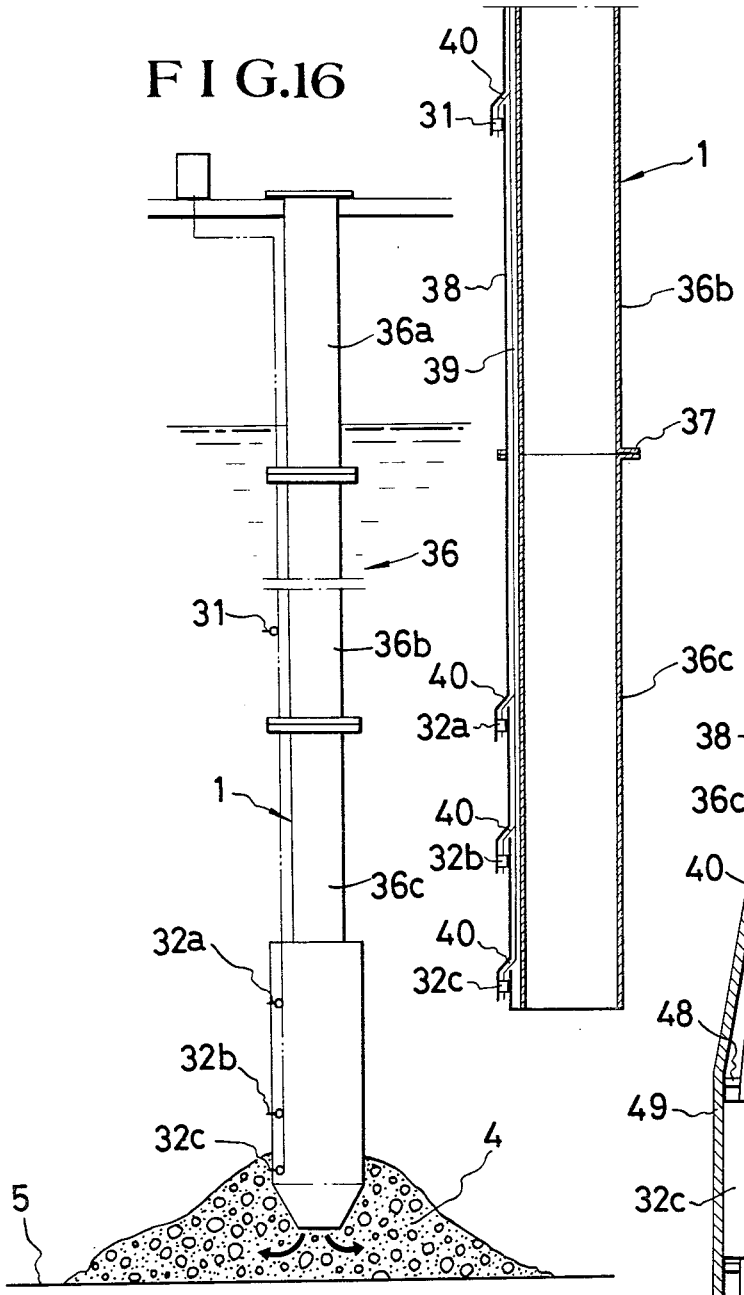
F I G.18
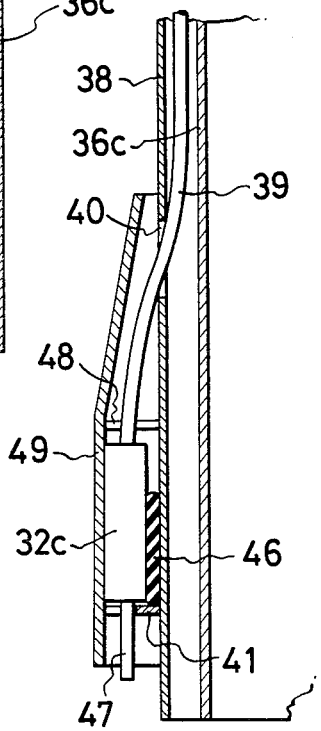

METHOD AND APPARATUS FOR PLACING CONCRETE UNDER WATER

BACKGROUND OF THE INVENTION (1) Field of the Invention

This invention relates to a method and an apparatus for placing concrete under water. More particularly, the invention relates to an improved tremie tube having a novel valve device.

(2) Description of the Prior Art

With the progress of the recent construction engineering, the need to place concrete or other hydraulic materials under water have been much increased.

When foundations or pedestals are constructed under water with concrete, a certain quantity of fresh concrete is placed step by step since the area to deposit the concrete is large, which is different from the construction of postholes. If the concrete is placed through the so-called tremie tube step by step, the water runs into the tube each time the tremie tube is lifted from the deposited concrete. Therefore, it has been regarded as unsuitable to use the conventional tremie tube for such a case. However, if the influx of water from the outlet of the tremie tube when the supply of concrete is ceased, can be avoided, the utility of the tremie tube will be much improved.

BRIEF SUMMARY OF THE INVENTION

In view of the above-described circumstances, the inventors of the present invention have carried out extensive investigations in order to improve the performance of the tremie tube. As a result, the improved method and apparatus for placing concrete under water have been achieved.

It is, therefore, the primary object of the present invention to provide a novel method and apparatus for placing concrete under water, in which a tremie tube is provided with a special valve device. The valve device is attached to the outlet of the tremie tube and, by closing the valve device, neither the leakage of concrete from the tremie tube nor the influx of water into the tremie tube will occur when the tremie tube is lifted after the supply of concrete through the tremie tube. Therefore, the tremie tube can be moved to the next point in water without any disadvantage.

Another object of the present invention is to provide a method for placing concrete under water and the apparatus used therefor, in which the special valve device attached to the tremie tube is quite effective, easy in operation and simple in structure so as to be produced at a low cost and operated without any trouble.

Another object of the present invention is to provide a method for placing concrete under water and the apparatus used therefor, in which the top surface level of the deposited concrete can be easily detected by electrical means.

In accordance with the present invention, the method for placing concrete under water comprises the steps of: immersing a tremie tube into water, the inside of the outlet of the tremie tube being provided with a special valve device; transferring a predetermined quantity of concrete to the bottom of the water through the tremie tube; closing the outlet of the tremie tube by the special valve device while the outlet is kept in the deposited concrete; and lifting up the tremie tube so as to move it to the next site to place concrete.

The above valve device is provided with a cylindrical elastic valve member which is concentrically fitted within a cylindrical member forming a part of a concrete passage therein without reducing the diameter of the passage. The brims on both sides of the elastic valve member are tightly fixed to the cylindrical member so as to form a space to receive a pressurized fluid between the elastic valve member and the cylindrical member. When a pressure is exerted to the above space to receive a fluid, the elastic valve member is expanded inwardly and radially with being folded at a plurality of portions so that the outlet of the tremie tube is completely closed.

In accordance with another aspect of the present invention, the top surface level of the deposited concrete can be easily detected by electrical means, in which a thermistor for detecting the temperature of water and other thermistors for detecting the temperatures of the deposited concrete are attached to the side wall of the tremie tube and, when the temperature difference between the water and the deposited concrete exceeds a certain value, alarm signals are issued to indicate the state of the concrete placing or the vertical thickness of the deposited concrete.

BRIEF DESCRIPTION OF THE DRAWINGS

These and other objects and features of the present invention will become more apparent from the following description taken in connection with the accompanying drawings in which:

FIG. 16 is a side elevational view of a tremie tube which is provided with the above detecting device;

FIG. 17 is a vertical cross sectional view of a part of the tremie tube showing the attachment of thermistors; and FIG. 18 is an enlarged cross sectional view of a part of FIG. 17.

DETAILED DESCRIPTION OF THE INVENTION

Referring now to the accompanying drawings, the present invention will be described in detail with reference to the embodiments of the apparatus.

Figure 2:
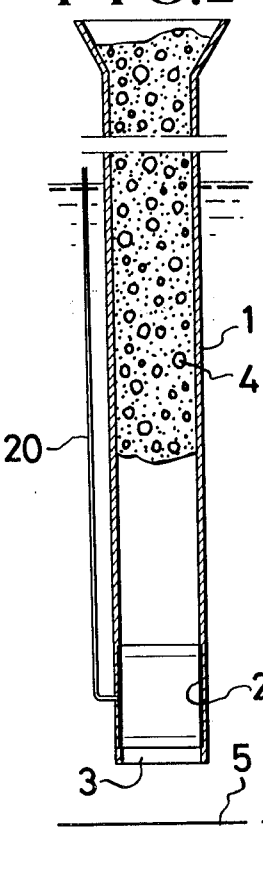
Figure 1:
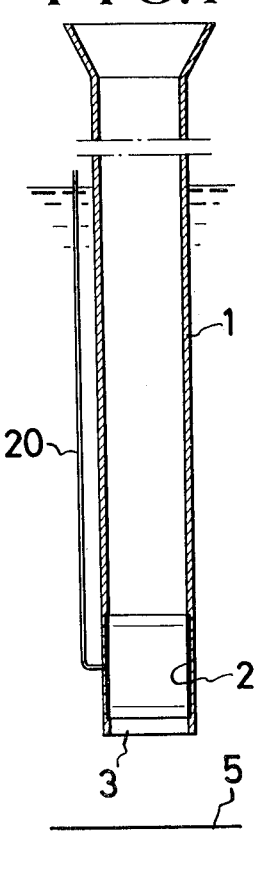
FIG. 1 is a schematic vertical cross sectional view of the tremie tube which is used in the method of the present invention.

In FIG. 1, the inside wall near the outlet 3 of a tremie tube 1 is provided with a tubular elastic valve member 2 which is made of, for example, natural or synthetic rubber. The reference numeral 4 in FIG. 2 is ready-mixed or fresh concrete to be deposited.

Figure 8:
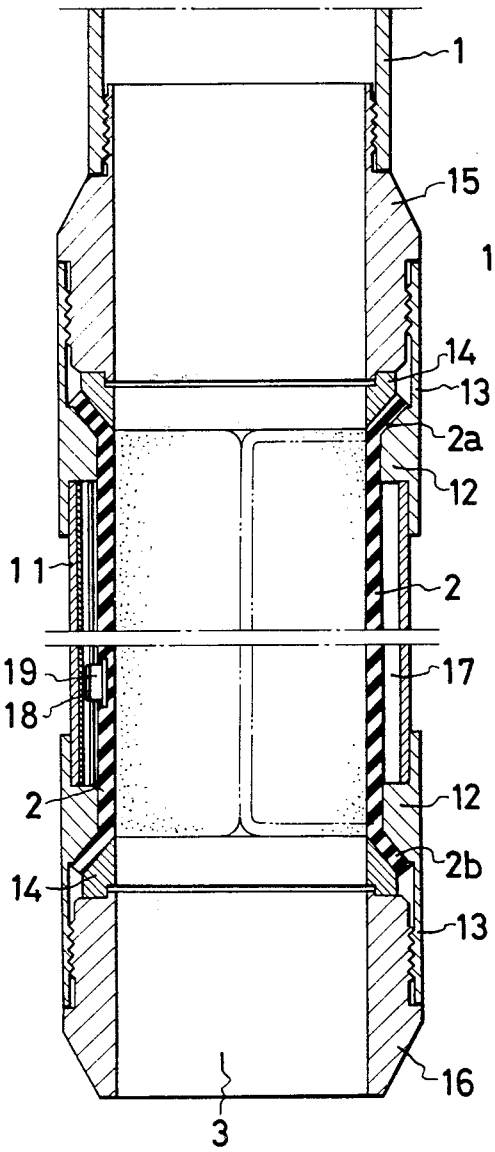
FIG. 8 is an enlarged vertical cross sectional view of a valve device which is attached to the outlet of the tremie tube.

The above-mentioned elastic valve member 2 can be expanded toward the axis of the tremie tube 1 by the pressure of a fluid such as air, water or oil, so as to close up the outlet 3 of the tube 1. The examplar structure of the outlet 3 which is provided with the elastic valve member 2 is shown more particularly in FIGS. 8 to 10. A cylindrical member 11 is firmly supported by a pair of sleeves 13 at the upper and the lower brims thereof. Formed on the inside wall of the upper sleeve 13 is an inner circular projection 12 which has a tapered surface on its upper side wall. The other lower sleeve 13 is also provided with a similar circular projection 12 having a tapered surface on the lower side wall thereof. The brims *2a* and *2b* of the above-mentioned elastic valve member 2 are pinched by the above tapered surfaces of circular projections 12 and a pair of rings 14 which are also provided with tapered surfaces on the sides facing the tapered surfaces of the circular projections 12 of both the sleeves 13. The rings 14 are pressed by the short cylinder 15 that is screwed to the upper sleeve 13 and the other short cylinder 16 that is screwed to the lower sleeve 13, respectively. The lower short cylinder 16 serves as the outlet 3 of the tremie tube 1. Between the cylindrical member 11 and the elastic valve member 2 is formed a space 17 for receiving a hydraulic or pneumatic fluid.

Figure 9:
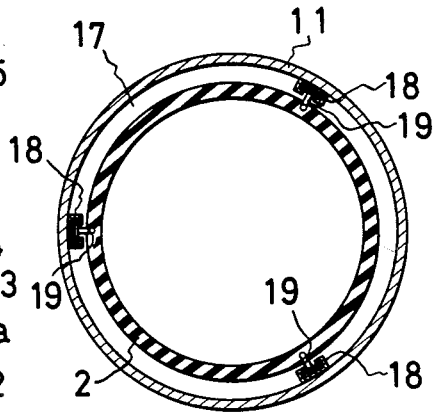
FIG. 9 is a horizontal cross sectional view of the above valve device.
Figure 10:
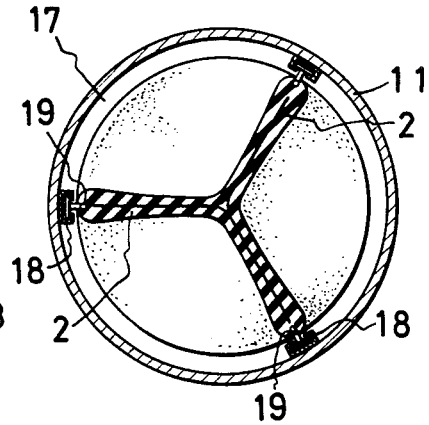
FIG. 10 is also a horizontal cross sectional view of the valve device in which the elastic valve member is closed.

As shown in FIGS. 9 and 10, three hinges 19 are embedded in the elastic valve member 2 at regular intervals and the hinges 19 are attached to vertical stays 18 which are fixed to the inside wall of the above-described cylindrical member 11. When the pressure of a hydraulic or pneumatic fluid is applied to the spaces 17, the elastic valve member 2 is deformed in the inwardly radial three directions where the elastic valve member 2 is folded at the portions of hinges 19. Further, in place of the above hinges 19, other devices such as core rods can also be used by embedding them in the elastic valve member 2.

With reference to FIGS. 2 to 5, the method of the present invention for placing concrete using the above-described tremie tube 1 will be illustrated.

As shown in FIG. 2, the elastic valve member 2 of the tremie tube 1 is allowed to shrink so as to open the outlet 3 and the tremie tube 1 is immersed into water and set to a predetermined site on the bottom of the water. The supply of fresh concrete 4 is then started.

Figure 3:
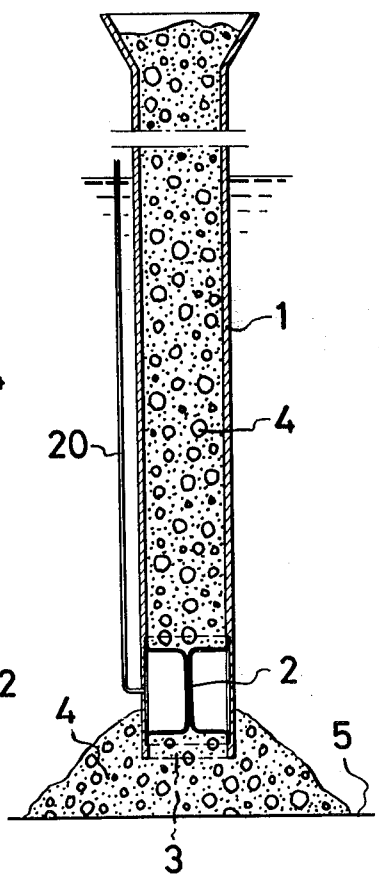

In the next step as shown in FIG. 3, when a predetermined quantity of concrete 4 is deposited, the space 17 is supplied with a certain fluid under pressure so as to expand the elastic valve member 2 without drawing the tremie tube 1 out of the placed concrete 4. When the elastic valve member 2 is expanded, three vertically oriented portions of the elastic valve members 2 are folded and the outlet 3 is thus closed.

Figure 4:
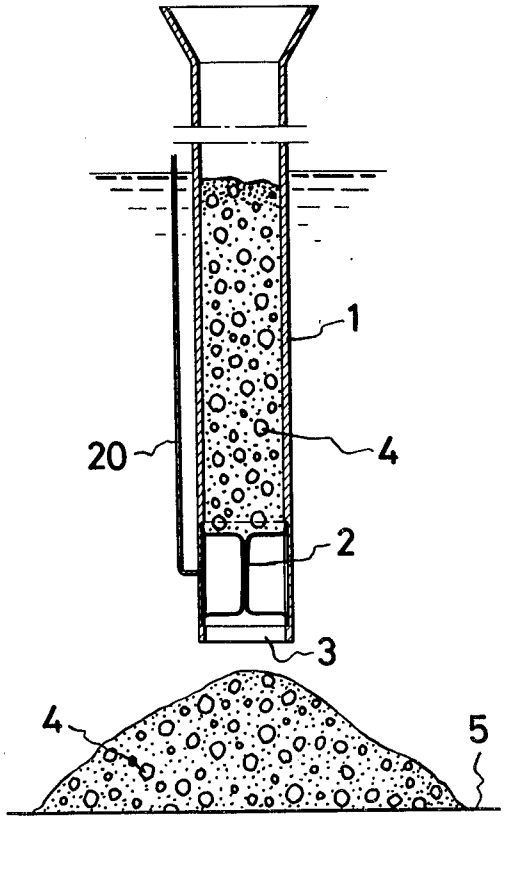
FIG. 2 to FIG. 6 are vertical cross sectional views which schematically show the procedure of underwater concrete placing in sequence.
Figure 6:
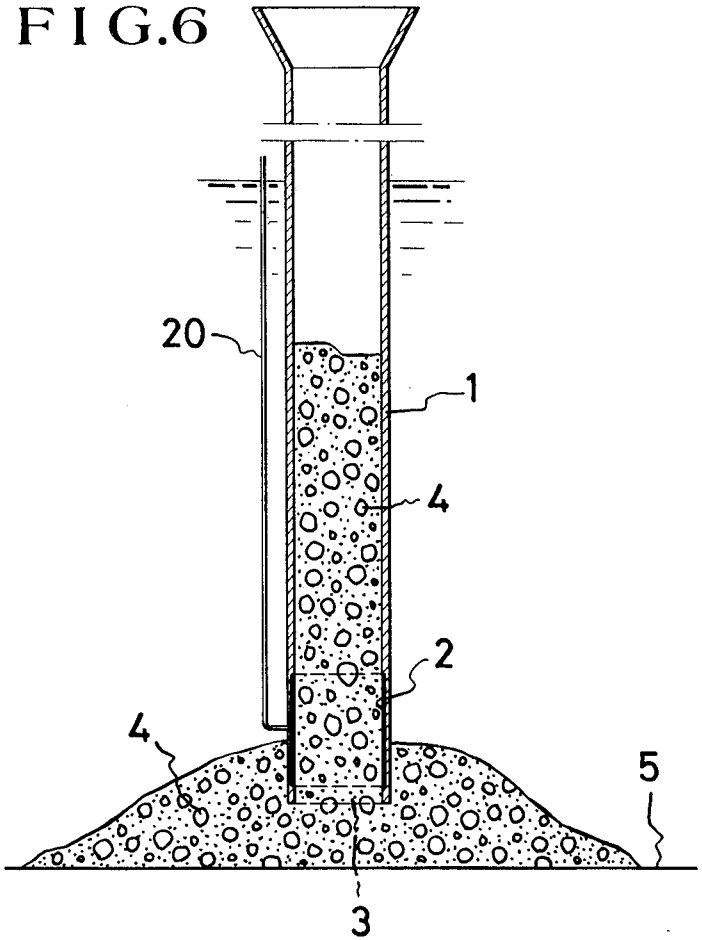

When the outlet 3 is completely closed without the fear of the inrush of water, the tremie tube 1 is lifted to a certain height as shown in FIG. 4 and the tremie tube 1 can be moved to the next position to place concrete.

Where a part of concrete has already been deposited in the next site, the outlet 3 of the tremie tube 1 is shoved into the concrete 4, the outlet 3 is opened then by causing the elastic valve member 2 to shrink, and a further supply of concrete is started (See FIG. 6).

Figure 5:
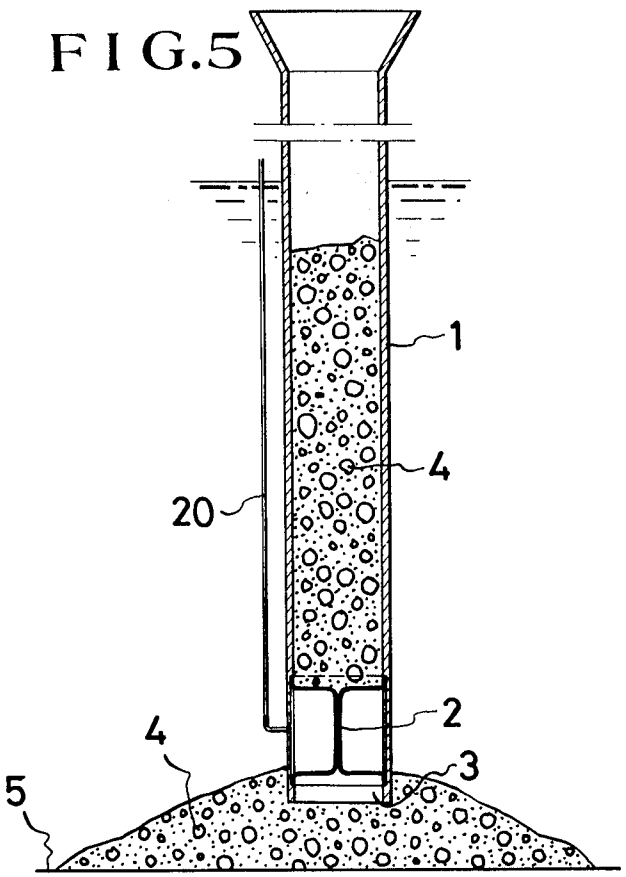

By repeating the steps of FIG. 4 to FIG. 6, the underwater placing of concrete into concrete molds can be carried out.

Figure 7:
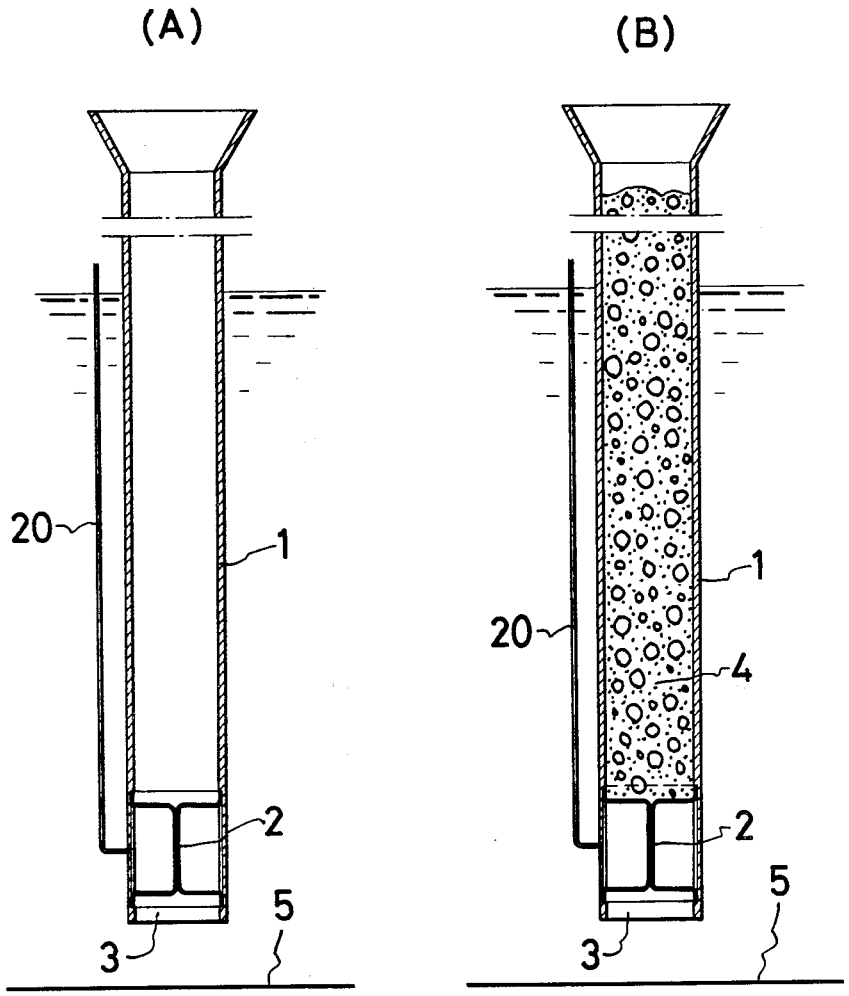
FIGS. 7(A) and 7(B) are vertical cross sectional views which show the setting of the tremie tube.

In the case shown in FIG. 7(A), a pressurized fluid is supplied into the space 17 between the cylindrical member 11 and the elastic valve member 2, thereby closing the outlet 3 by the expansion of the elastic valve member 2. The tremie tube 1 is then introduced into the water. While, in the case shown in FIG. 7(B), the concrete 4 is filled into the tremie tube 1 after the outlet 3 is closed up and such tube 1 is then introduced into the water. When the water is shallow, the case of FIG. 7(A) may be serviceable, however, it is advisable that the tremie tube 1 in the state of FIG. 7(B) be led into the water, especially when the water is deep.

In the above-described novel method for placing concrete, the outlet of the tremie tube is operated by the elastic valve member which can be expanded under the pressure of a fluid, and with such a device, the placing of concrete and the moving of the tremie tube can be carried out. That is, the water does not run into the tremie tube when it is moved from place to place and the concrete placing work can be performed in the conventional manner. Further, since the elastic valve member is simple in structure, the configuration of the outlet is also made simple and since the elastic valve member is shrunk to the same level as the inside wall of the tremie tube, the concrete passage does not become narrow. Accordingly, the opening and closing of the outlet can be done without fail and the concrete placing can be performed without delay. Further, since the outlet is closed by the expansion of the elastic valve member while the outlet is held in the placed concrete, there is no problem of water flowing into the tremie tube in each concrete placing work so that there is no need of special handling when the tremie tube is transferred to another place.

Figure 11:
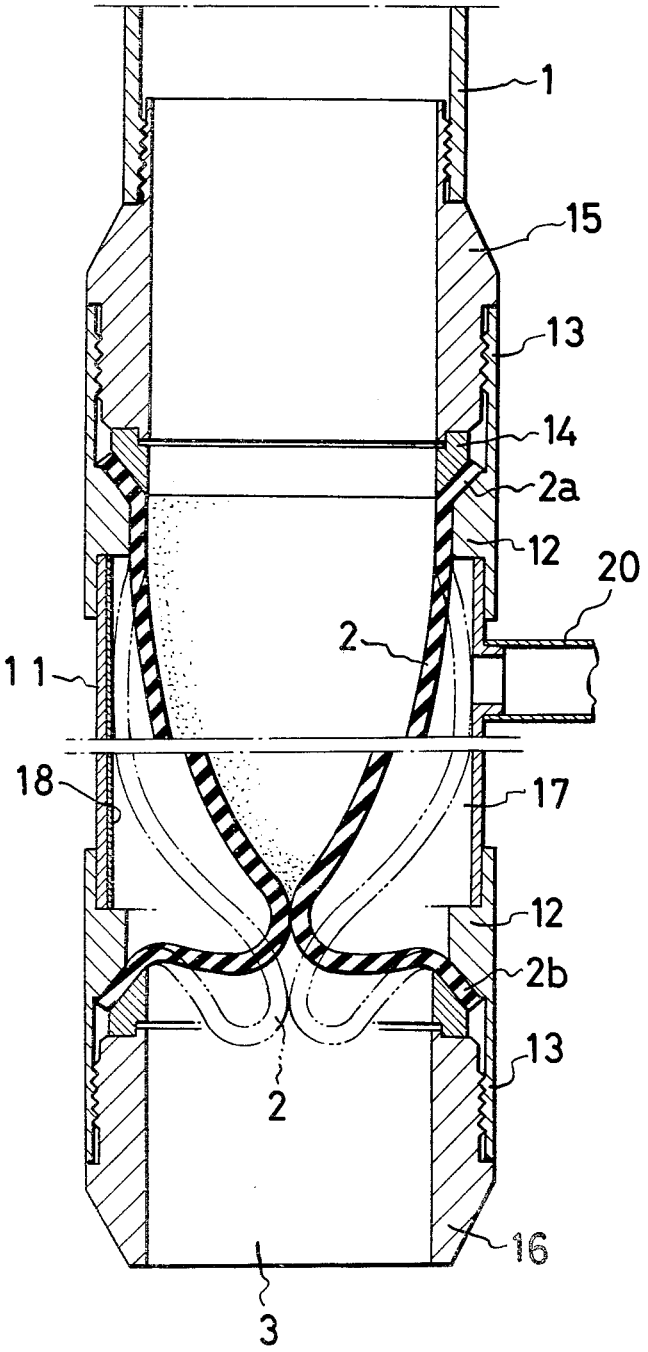
FIG. 11 is a schematic illustration in cross section of the valve device in which the air pipe is closed up by the elastic valve member due to the load of the concrete.

However, when the elastic valve member 2 that is attached to the outlet 3 of the tremie tube 1 receives the total load of the cement composition within the tremie tube 1, the elastic valve member 2 is sometimes unevenly restored to the original configuration since it is made of an elastic material. If the elastic valve member 2 is deformed as shown in FIG. 11 due to the load of the concrete, when the air in the space 17 is released so as to open the valve, the air near the air pipe 20 is firstly released, and at the same time, the upper portion of the elastic valve member 2 is pressed against the inside wall of the cylindrical member 11 by the load of the concrete and the flow of air is interrupted, capturing the remaining air in the lower part of the air space 17. Therefore, in such a case, complete opening of the valve cannot be expected.

When the cement composition is supplied into the tremie tube 1 under pressure without knowledge of the occurrence of such a phenomenon, the still expanded valve member 2 with the remaining air receives further a large load of the contents and it is pushed out of the cylindrical member 11 forming an annular bag as shown by the chain lines in FIG. 11. Eventually, the elastic valve member 2 will be ruptured.

The stoppage of this air pipe 20 can be avoided to some extent by attaching the air pipe 20 to the lower part of the cylindrical member 11, the portion in which the influence of the load of cement composition is smallest.

Figure 12:
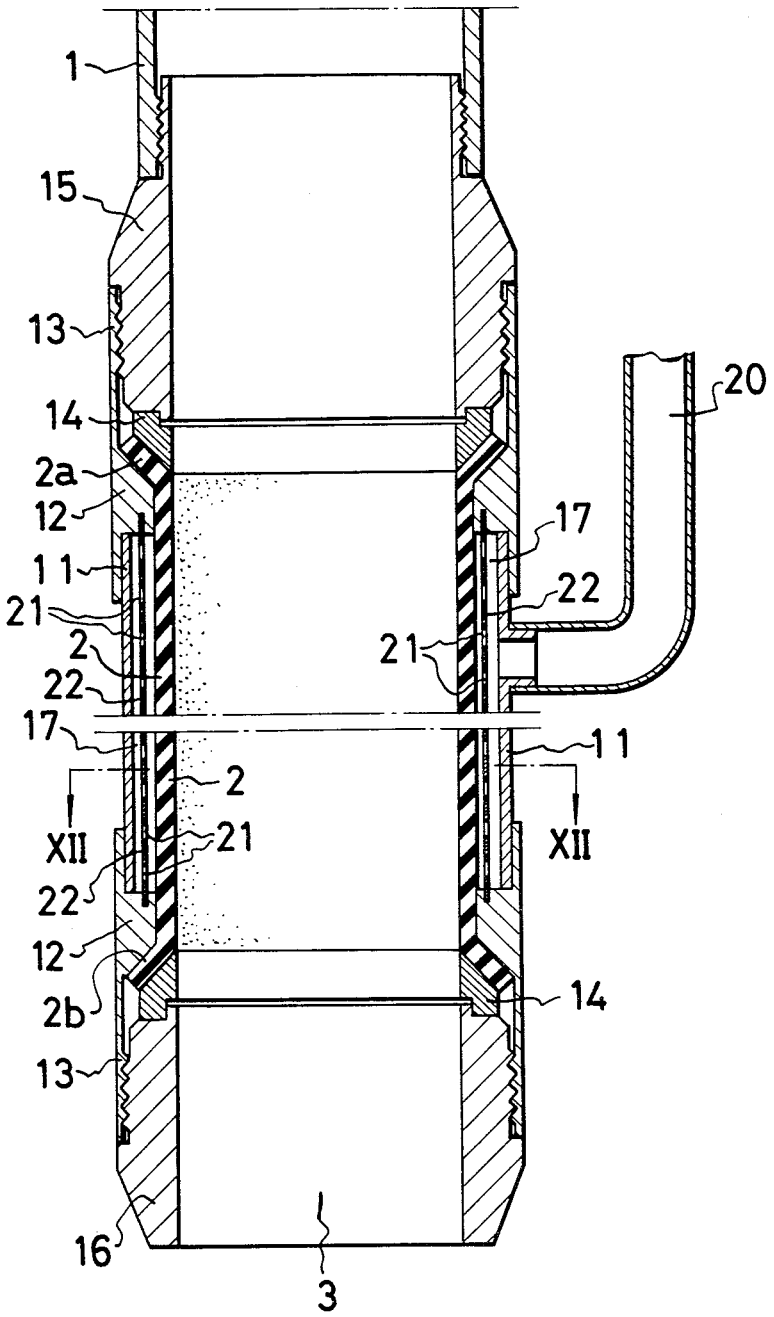
FIG. 12 is an enlarged vertical cross sectional view of another embodiment of the valve device.

Further, in accordance with the embodiment shown in FIG. 12, the stoppage of the air pipe 20 by the elastic valve member 2 can be completely avoided, even when the supporting members such as hinges and stays are omitted and, the elastic valve member 2 can be folded at the three points when it is expanded.

More particularly, the fluid space 17 is provided with a partition member 22 which has a shape of a short tube and is larger in diameter than that of the foregoing elastic valve member 2. Formed in the side wall of this partition member 22 are a plurality of perforations 21 to allow the pressurized fluid to pass through. Therefore, the fluid space 17 is divided into two parts and the air pipe 20 communicates with the outer fluid space. The pressurized fluid from the air pipe 20 is thus supplied to the elastic valve member 2 on the inner fluid space through the passages of the perforations 21.

Figure 14:
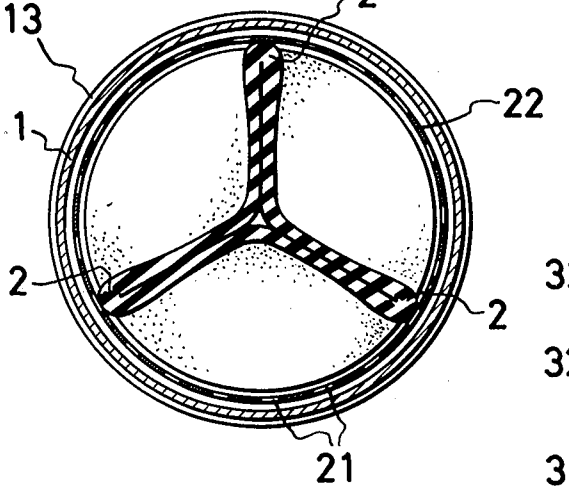
FIG. 14 is also a horizontal cross sectional view of the same in which the elastic valve member is closed.
Figure 13:
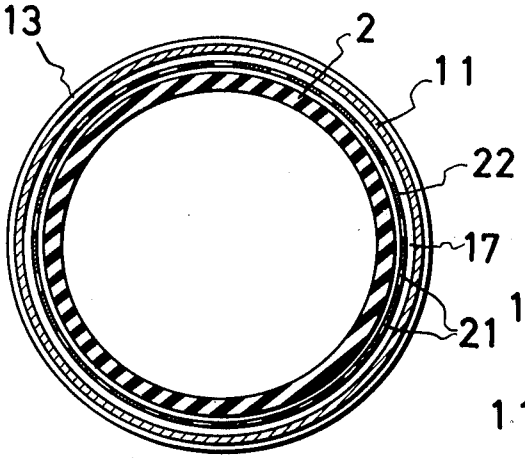
FIG. 13 is a horizontal cross sectional view of the embodiment shown in FIG. 12 taken along the line XII—XII in the same figure.

With the above-described structure, when air is supplied into the fluid space 17 under pressure, the elastic valve member 2 is expanded toward the center of the concrete passage by the pressure of the air. Since the circumference of the elastic valve member 2 is about three times the diameter of the partition member 22, when the pressurized fluid is supplied, the elastic valve member 2 in the form of FIG. 13 is naturally deformed into the form of FIG. 14 without any special treatment, in which the elastic valve member 2 is folded at three points at regular intervals into a cross-sectionally trifurcated shape as shown in FIG. 14, thereby closing the concrete passage of the tremie tube 1. Further, when the air in the fluid space 17 is exhausted, the elastic valve member 2 is pressed toward the inside wall of the cylindrical member 11, and, the flow of air is not inhibited owing to the provision of the partition member 22 and all the air inside the partition member 22 can be exhausted through the perforations 21. Accordingly, the elastic valve member 2 closes the outlet of the tremie tube 1 without fail by the pressure of the fluid that is introduced into the fluid space 17, while the tube 1 is promptly opened by the exhaustion of the fluid.

Figure 15:
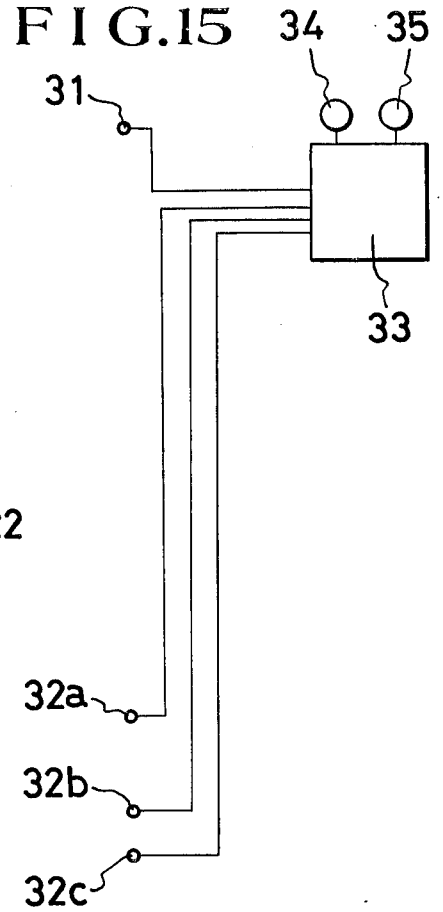
FIG. 15 is a block diagram of the device for detecting the thickness of the deposited concrete.

The embodiment which is shown in FIG. 15 is used for detecting the temperature of the surrounding water and the temperature rise caused by the heat of setting of the concrete. That is, by detecting the difference between such temperatures by electrical means, it can be determined whether the bottom end of the tremie tube is positioned in the deposited concrete or not, and, the position of the top level of deposited concrete that is moving upward can be detected and, thus the thickness of the placed concrete can be readily estimated.

In this embodiment, a thermistor 31 for detecting the temperature of water and other thermistors **32*a*, 32*b* and 32*c* for detecting the temperatures of concrete are electrically connected to a detecting device 33 which is provided with an alarm circuit. When a predetermined difference in temperatures of water and concrete is detected, the buzzer 34 of the alarm circuit is energized by the action of the detecting device 33 and the lamp 35** is simultaneously turned on.

The above-described thermistor 31 for detecting the water temperature is attached to an upper portion of the tremie tube 1 and the other thermistors **32*a*, 32*b* and 32*c* for detecting the concrete temperatures are attached to the predetermined points in the lower part of the tremie tube 1**.

FIGS. 16 and 17 show the manner of setting of the thermistors 31, **32*a*, 32*b*, and 32*c* to the tremie tube 1. A guide casing 38 for the electric cords 39 of the thermistors is attached along the side walls of a plurality of tubes 36*a*, 36*b*, and 36*c*. In this embodiment, the flange portions between the adjoining tubes are cut off so as to allow the guide casing 38 to pass straightly. At predetermined points of the guide casing 38, openings 40 are formed, from which the branches of the cord 39 are extended and the thermistors 31, 32*a*, 32*b*, and 32*c*** are respectively connected to the branches.

FIG. 18 shows further detailed structure of the attachment of the thermistor **32*c* that is positioned on the side near the outlet of the tremie tube 1. A base plate 41 is fixed below the opening 40 and above the base plate 41 is attached a rubber piece 46. The thermistor 32*c* is placed with its face downward and the probe 47 is stuck out from the base plate 41. The thermistor 32*c* is further covered with a cover plate 49 having a supporting piece 48 on the inside wall thereof. Incidentally, the rubber piece 46 can also be fitted on the side of the cover plate 49**.

When the tremie tube 1 having the above-described thermistors is employed in concrete placing, the tremie tube 1 is set to the bottom 5 of water in like manner as the case of FIG. 2. then the concrete 4 is transferred to the bottom of water from the outlet 3 by actuating the thermistors 31, **32*a*, 32*b*, and 32*c* by electric currents. With the progress of the deposition of the concrete 4, the outlet 3 of the tremie tube 1 is enveloped by the deposited concrete 4. The heat of hydration is generated in the setting of the concrete 4, so that the heat is detected by the lowermost thermistor 32*c* and, when the temperature difference between the water temperature and the temperature detected by the thermistor 32*c* is detected, the buzzer 34 is actuated and the lamp 35 that indicates the thermistor 32*c* is turned on. When the quantity of the deposited concrete 4 increases to reach the level of the thermistor 32*b*, the temperature rise is detected by the thermistor 32*b* that is buried in the concrete 4, and the lamp indicating the thermistor 32*b* is turned on, from which it can be estimated that the level of the concrete surface has been raised to the thermistor 32*b*. When the concrete is further supplied, the surface level of the concrete 4 is finally indicated by the detection of the thermistor 32*a*. Accordingly, if the thermistor 32*a* is attached to the necessary height H of concrete placing, the quantity of the deposited concrete can be easily detected without fail when the tremie tube 1** is pulled up.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A method for placing concrete under water, comprising the steps of:

immersing into water a substantially rigid tremie tube having a conduit for the passage of concrete from an inlet to an outlet and having an elastic valve member disposed adjacent said outlet and forming a portion of said conduit, said valve member having the same cross-sectional configuration as said conduit when said valve member is in an opened condition, and said valve member being in said opened condition during said immersing step;

transferring a predetermined quantity of concrete through said conduit from said inlet to said outlet and to an underwater surface adjacent said outlet;

closing said valve member while said outlet remains immersed in concrete deposited on said surface;

said closing step comprising the steps of:

conducting pressurized fluid from an external source to an annular compartment surrounding and concentric with said elastic valve member;

expanding said annular compartment radially inward into said conduit in three discrete axially aligned sections by means of said pressurized fluid, each of said sections being separated from one another by support means oriented longitudinally parallel to the axis of said tube, said support means securing said valve member to inner surfaces of said conduit; and sealing said conduit by conducting sufficient pressurized fluid to said annular compartment to cause radially inwardly facing surfaces on each of said three sections to engage corresponding radially inwardly facing surfaces of the others of said three sections;

raising said tremie tube so that said outlet is above concrete deposited on said surface; and moving said tremie tube to another location.

2. A method for placing concrete under water comprising the steps of:

closing an elastic valve member in a substantially rigid tremie tube having a conduit for the passage of concrete from an inlet to an outlet, said valve member being disposed adjacent said outlet and forming a portion of said conduit;

immersing said tremie tube into water until said outlet is adjacent a surface upon which concrete is to be deposited, said conduit of said tremie tube having a substantially uniform cross-sectional configuration throughout the length thereof;

opening said valve member, said valve member being substantially concentric with said tremie tube and having a cross-sectional configuration substantially identical to said cross-sectional configuration of said conduit when in a fully opened condition;

transferring a predetermined quantity of concrete through said conduit from said inlet to said outlet and onto said surface;

closing said valve member while said outlet remains immersed in concrete deposited on said surface;

raising said tremie tube so that said outlet is above concrete deposited on said surface; and moving said tremie tube to another location;

said closing steps each comprising the steps of:

conducting pressurized fluid from an external source to an annular compartment surrounding and concentric with said elastic valve member;

expanding said annular compartment radially inward into said conduit in three discrete axially aligned sections by means of said pressurized fluid, each of said sections being separated from one another by support means oriented longitudinally parallel to the axis of said tube, said support means securing said valve member to inner surfaces of said conduit; and sealing said conduit by conducting sufficient pressurized fluid to said annular compartment to cause radially inwardly facing surfaces on each of said three sections to engage corresponding radially inwardly facing surfaces of the others of said three sections;

said opening step comprising the steps of:

venting said annular compartment to allow pressurized fluid to escape therefrom; and allowing said valve member to return to said fully opened position of its own accord under the elastic influence thereof.

3. A method for placing concrete under water comprising the steps of:

closing an elastic valve member in a substantially rigid tremie tube having a conduit for the passage of concrete from an inlet to an outlet, said valve member being disposed adjacent said outlet and forming a portion of said conduit;

introducing into said tremie tube a predetermined quantity of concrete through said inlet;

immersing said tremie tube into water until said outlet is adjacent a surface upon which concrete is to be deposited, said conduit of said tremie tube having a substantially uniform cross-sectional configuration throughout the length thereof;

opening said valve member, said valve member being substantially concentric with said tremie tube and having a cross-sectional configuration substantially identical to the cross-sectional configuration of said conduit when in a fully opened position;

transferring a quantity of concrete through said conduit from said inlet to said outlet and onto said surface;

closing said valve member while said outlet remains immersed in concrete deposited on said surface;

raising said tremie tube so that said outlet is above concrete deposited on said surface;

moving said tremie tube to another location;

said closing steps each comprising the steps of:

conducting pressurized fluid from an external source to an annular compartment surrounding and concentric with said elastic valve member;

expanding said annular compartment radially inward into said conduit in three discrete axially aligned sections by means of said pressurized fluid, each of said sections being separated from one another by support means oriented longitudinally parallel to the axis of said tube, said support means securing said valve member to inner surfaces of said conduit; and sealing said conduit by conducting sufficient pressurized fluid to said annular compartment to cause radially inwardly facing surfaces on each of said three sections to engage corresponding radially inwardly facing surfaces of the others of said three sections;

said opening step comprising the steps of:

venting said annular compartment to allow pressurized fluid to escape therefrom; and allowing said valve member to return to said fully opened position of its own accord under the elastic influence thereof.

4. An apparatus for placing concrete under water, comprising:

a substantially rigid, cylindrical tube having an inner passage for conducting concrete from an inlet above a water surface to an outlet below said water surface, and having a substantially uniform cross-sectional configuration along the length thereof;

a substantially cylindrical elastic valve member adjacent said outlet and forming a portion of said passage, said valve member having an upper lip extending around an inner surface of said passage on an end of said valve member facing said inlet and a lower lip extending around an inner surface of said passage on an end of said valve facing said outlet, said valve member being concentric with said structure and having a cross-sectional configuration substantially identical to said cross-sectional configuration of said tube when said valve member is in an opened position;

means securing said upper lip and said lower lip to said inner surface of said passage to form a sealed annular space between an outer wall of said tube and an outer surface of said valve member;

three supporting members oriented longitudinally parallel to the axis of said tube and adapted to secure said valve member to said tube and to divide said space into three discrete chambers, each of said chambers being bounded by said upper lip, said lower lip and two of said supporting members, and each of said chambers being separated from others of said chambers;

means for supplying a pressurized fluid to each of said chambers to expand each of said chambers radially inward into said passage until radially inwardly facing surfaces of each of said chambers engage corresponding radially inwardly facing surfaces of the others of said chambers to seal said passage and to prevent the flow of concrete therethrough; and means for removing said pressurized fluid from each of said chambers to permit said chambers to deflate and to permit said valve member to return of its own accord to said opened position.

5. An apparatus for placing concrete under water as recited in claim 4 further comprising a perforated sleeve disposed within said space, concentric with and surrounding said valve member, said sleeve dividing said space into a first annular compartment adapted to receive fluid from said supply means and for conducting fluid to said removing means, and a second annular compartment adapted to receive fluid from said first annular compartment through perforations in said sleeve, said second annular compartment being divisible into said three chambers.

* * * * *